US006271718B1

(12) United States Patent
Sohn et al.

(10) Patent No.: US 6,271,718 B1
(45) Date of Patent: Aug. 7, 2001

(54) INTERNAL VOLTAGE CONVERTER FOR LOW OPERATING VOLTAGE SEMICONDUCTOR MEMORY

(75) Inventors: Kyo-Min Sohn, Seoul; Young-Ho Suh, Suwon, both of (KR)

(73) Assignee: Samsung Electronics, Suwon (KR)

( * ) Notice: Subject to any disclaimer, the term of this patent is extended or adjusted under 35 U.S.C. 154(b) by 0 days.

(21) Appl. No.: 09/675,125

(22) Filed: Sep. 28, 2000

Related U.S. Application Data

(63) Continuation of application No. 09/288,771, filed on Apr. 8, 1999, now Pat. No. 6,150,873.

(30) Foreign Application Priority Data

Jun. 8, 1998 (KR) ..... 98-21036

(51) Int. Cl.[7] ..... G05F 3/02
(52) U.S. Cl. ..... 327/540; 327/536
(58) Field of Search ..... 327/534, 535, 327/536, 537, 538, 539, 540, 541, 542, 543, 544, 545, 546, 548

(56) References Cited

U.S. PATENT DOCUMENTS 5,347,170 * 9/1994 Hayakawa et al. ..... 307/296.1

OTHER PUBLICATIONS

H.J. Shin et al., "Low–Dropout On–Chip Voltage Regulator for Low–Power Circuits," 1994 IEEE, pp. 76–77.

* cited by examiner

*Primary Examiner*—Jeffrey Zweizig
(74) *Attorney, Agent, or Firm*—Marger Johnson, & McCollom, P.C.

(57) ABSTRACT

The present invention provides an internal voltage converter that comprises a voltage down converter which receives an external voltage and provides an intermediate voltage that is stable and lower than the external voltage. The intermediate voltage is used to operate a clock signal generator and a timing controller that produces a timing signal. The regulator also includes a booster that receives the timing signal and the external voltage, and outputs a boosted voltage that is of a lower level than in the prior art. The regulator also includes a voltage source that receives the boosted voltage and the external voltage, and outputs the device's internal operating voltage for operating it.

14 Claims, 5 Drawing Sheets

INTERNAL VOLTAGE CONVERTER FOR LOW OPERATING VOLTAGE SEMICONDUCTOR MEMORY

This application is a continuation of Ser. No. 09/288,771, filed Apr. 8, 1999, now U.S. Pat. No. 6,150,873.

BACKGROUND OF THE INVENTION

1. Field of the Invention

The present invention relates to a semiconductor memory device, and more particularly to a voltage regulator circuit of a semiconductor memory device that operates at a low voltage.

2. Description of the Prior Art

The designed operating voltages of semiconductor memory devices are becoming lower, in order to increase integration and to decrease power consumption. Accordingly, increasingly lower external voltages are used to operate the devices, but that is not always enough. Thus voltage regulators are also used to convert the external voltage to the lower operating voltage of the device.

In the 1994 IEEE Symposium on the Low Electricity Electronical Engineering, a paper titled "Low-dropout On-chip Voltage Regulator for Low-Power Circuits" teaches to use a NMOS driver in the regulator of the semiconductor memory device. The paper teaches to use a boosting circuit to increase the voltage level of the control signal applied to the gate of the NMOS driver, as well as a clock signal generating circuit to operate the boosting circuit.

A problem is that, as operating voltages decrease further, a high external voltage is applied to the regulator can destroy the transistors of the boosting circuit and the clock signal generating circuit. The reason is that high voltage differences will be applied across the junctions of the transistors.

SUMMARY OF THE INVENTION

An object of the present invention is to provide a voltage regulator for a semiconductor memory device that can withstand an external voltage that is too high. The object is accomplished by the internal voltage converter of the present invention.

The internal voltage converter comprises a voltage down converter that receives the external voltage and provides an intermediate voltage lower than the external voltage. The regulator further comprises a timing pulse generator that receives the intermediate voltage and generates a timing signal. Since not powered directly by the higher external voltage, the timing pulse generator is thus protected. The timing pulse generator is preferably made by a clock signal generator that receives the intermediate voltage and produces a clock signal, and by a timing controller that receives the clock signal and produces the timing signal. Since the timing controller is powered by the lower intermediate voltage, the timing signal is of a lower level.

The regulator of the present invention further comprises a booster that receives the timing signal and the external voltage. The booster outputs a boosted voltage that is of a lower level than in the prior art. The regulator also includes a voltage source that receives the boosted voltage and the external voltage, and outputs the device's internal operating voltage for operating it. Since the boosted voltage is of a lower level, the voltage source is thus protected.

The voltage down converter can be a voltage source made as is known in the art. The voltage down converter is preferably made by a PMOS driver that receives the external voltage and outputs the intermediate voltage, and a second differential comparator that receives the external voltage and controls the PMOS driver. The second differential comparator senses the intermediate voltage and compares it to a reference voltage which is advantageously the same voltage reference used with the voltage source. In that case the intermediate voltage will be equal to the device's internal operating voltage.

Since the clock signal generator receives a stable voltage, the clock signal will be of stable frequency and amplitude. Further, the timing pulses produced by the timing controller will also be of stable frequency and amplitude. These and other features and advantages of the present invention will be better understood by the following Detailed Description and Drawings in which:

DETAILED DESCRIPTION OF THE PREFERRED EMBODIMENT

Hereinafter, with reference to the accompanying drawings, the internal voltage converter of the prior art will be first explained prior to an explanation of the internal voltage converter of the present invention.

Figure 1:
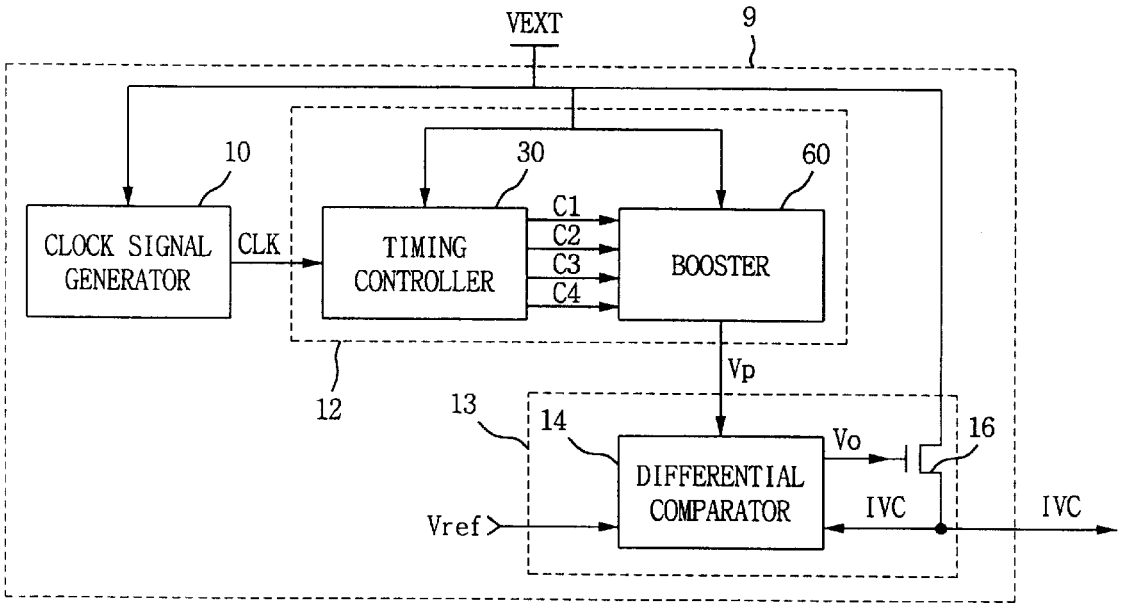
FIG.1(Prior Art)
FIG. 1 is a block diagram of a prior art voltage regulator of a semiconductor memory device.

FIG. 1 is a block diagram of a prior art voltage regulator 9. The regulator comprises a clock signal generator 10, and a boosting circuit 12 made of a timing controller 30 and a booster 60. Regulator 9 further includes a voltage source 13 made from a differential comparator 14 and a NMOS driver that includes a NMOS transistor 16.

Clock signal generator 10 receives external voltage VEXT and generates a clock signal CLK of a predetermined frequency. Timing controller 30 receives the clock signal and outputs 4 timing pulses C1, C2, C3 and C4. The timing pulses are input in booster 60, which in turn outputs a boosted voltage Vp.

Transistor 16 receives external voltage VEXT in the source, and outputs the device's internal operating voltage IVC from the drain, as controlled by the gate. Differential comparator 14 receives the boosted voltage and senses internal operating voltage IVC and a first reference voltage Vref. Comparator 14 outputs a control signal Vo to the gate of transistor 16 so as to maintain IVC equal to Vref.

Figure 2:
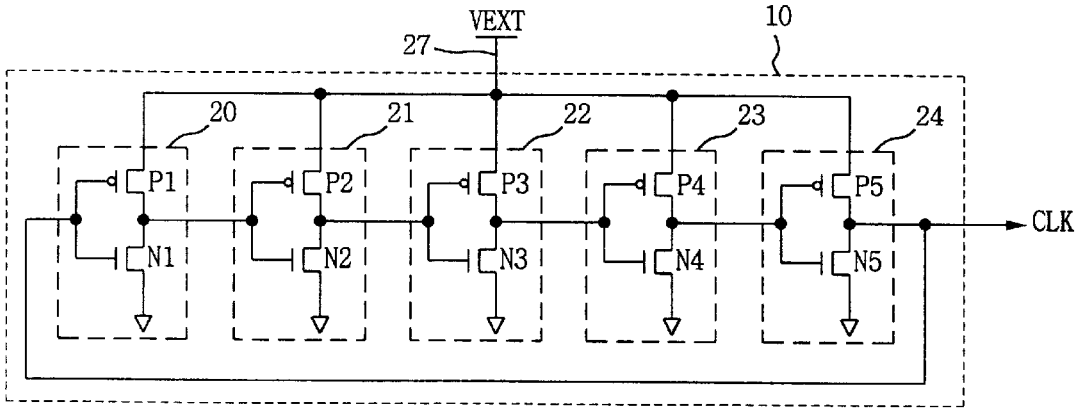
FIG.2(Prior Art)
FIG. 2 is a detailed circuit diagram of clock signal generator 10 of FIG. 1.

Clock signal generator 10 is now described referring to FIG. 2. It is made as a ring oscillator from 5 inverters 20, 21, 22, 23 and 24, connected consecutively in a ring arrangement. The inverters receive external voltage VEXT at a common terminal 27. Each inverter is made from a PMOS transistor (P1–P5 ) and an NMOS transistor (N1–N5). The output of the common node of the PMOS transistor and the NMOS transistor of one inverter is input in the gates of the transistors of the next inverter.

When external voltage VEXT is applied to terminal 27, generator 10 generates a clock signal CLK. The clock signal transits between the ground voltage and the external voltage (VEXT). The problem is that VEXT can be so high that it can cause voltage drops across the junctions of the transistors that are so large that can destroy them.

Another problem is that, if external voltage VEXT varies, the period of clock signal CLK varies accordingly. Specifically, if the external voltage increases the period becomes shorter, and if it decreases the period becomes longer.

Timing controller 30 is now described in detail with reference to FIG. 3. Timing controller 30 includes inverters 31 and 32 receiving and delaying the clock signal CLK, inverters 33, 34, 35 and 36 and inverters 39, 40, 41 and 42 for delaying the output signal of the inverter 32, NAND gates 37 and 43 for respectively non-logically multiplying clock signal CLK and the output signals of inverters 36 and 42, inverter 38 for reversing the output signal of NAND gate 37, inverters 44 and 45 for delaying the output signal of NAND gate 43, inverters 46, 47, 48 and 49 for delaying clock signal CLK, a NAND gate 50 for non-logically multiplying clock signal CLK and the output signal of inverter 49, an inverter 51 for reversing the output signal of NAND gate 50, and inverters 52, 53 and 54 for reversing and delaying the output signal of inverter 47.

Timing controller 30 modifies the pulse width and timing of the clock signal CLK for producing a timing signal. The timing signal includes first, second, third and fourth timing pulses C1, C2, C3 and C4. Specifically, the signal path made by inverters 31, 32, 33, 34, 35 and 36, NAND gate 37 and inverter 38 widens and delays the pulse width of clock signal CLK, generating timing pulse C1. The signal path made by inverters 31, 32, 39, 40, 41 and 42, NAND gate 43 and inverters 44 and 45 widens, delays and reverses the pulse width of clock signal CLK, generating timing pulse C2. The signal path made by inverters 46, 47, 48 and 49, NAND gate 50, and inverter 51 widens and delays the pulse width of clock signal CLK, generating timing pulse C3. Lastly, inverters 46, 47, 52, 53 and 54 delay and reverse clock signal CLK, generating timing pulse C4.

As a result, when timing pulses C1 and C3 are at the external voltage VEXT level, timing pulses C2 and C4 are the ground voltage level. And when timing pulses C1 and C3 are at the ground voltage level, timing pulses C2 and C4 are at the external voltage VEXT level.

A problem, then, is that the transistors of the timing controller are subjected to the same high voltage differences as those of clock signal generator 10. Another problem is that if the frequency of clock signal CLK changes, the frequency of the timing pulses also changes, and thus is not fixed.

Booster 60 is now described with reference to FIG. 3. It includes a NMOS transistor N6 connected as a diode with a gate and a drain to which external voltage VEXT is applied, a NMOS capacitor N7 with a gate connected to the source of N6 and with a source and a drain to which timing pulse C1 is applied, a NMOS transistor N8 with a drain to which external voltage VEXT is applied and with a gate connected to the gate of N7, a NMOS transistor N9 connected as a diode with a source connected to the source of N8, and with a gate and a drain to which external voltage VEXT is applied, a NMOS capacitor N10 with a gate connected to the source of N8 and with a source and a drain to which timing pulse C2 is applied.

Booster 60 further includes a NMOS transistor N11 connected as N6, a NMOS capacitor N12 connected to N11 as N7 is to N6, except that timing pulse C3 is applied to its gate and drain, a NMOS transistor N13 connected to N12 as N8 is to N7, a NMOS transistor N14 connected to N13 as N9 is to N8, a NMOS capacitor N15 receiving timing pulse C4 as N10 receives C2 and connected to N13 as N10 is connected to N8.

Booster 60 also includes a NMOS transistor N16 with a source connected to the boosted voltage Vp output terminal, a drain connected to the gate of N10, and a gate connected to the gate of N15. It additionally includes a NMOS capacitor N17 with a drain and a source commonly connected to the ground, and with a gate connected to the boosted voltage Vp output terminal.

Booster 60 works as follows. A voltage is caught in nodes n1, n2, n3 and n4, which are at the sources of diodes N6, N9, N11 and N14 respectively. The voltage is left from external voltage VEXT, and is diminished by diode threshold voltage Vtn.

When timing pulses C1 and C3 are at VEXT, nodes n1 and n3 are boosted to the voltage VEXT−Vtn+VEXT level by N7 and N12. Therefore, N8 and N13 are completely on, and capacitors N10 and N15 connected to nodes n2 and n4 become charged to the VEXT level.

Then, the timing pulses are transited. This means that C1 and C3 are at the ground level, and C2 and C4 are at the VEXT level. Then nodes n1 and n3 maintain the voltage VEXT−Vtn, and nodes n2 and n4 are boosted to the VEXT+VEXT level by nodes n2 and n4. Then, the voltage boosted by N16 turning on is outputted to the boosted voltage Vp output terminal. This boosted voltage Vp is charged to capacitor N17. The boosted voltage Vp is generated while the above operation is repeated while responding to the transition of the clock signal.

Figure 3:
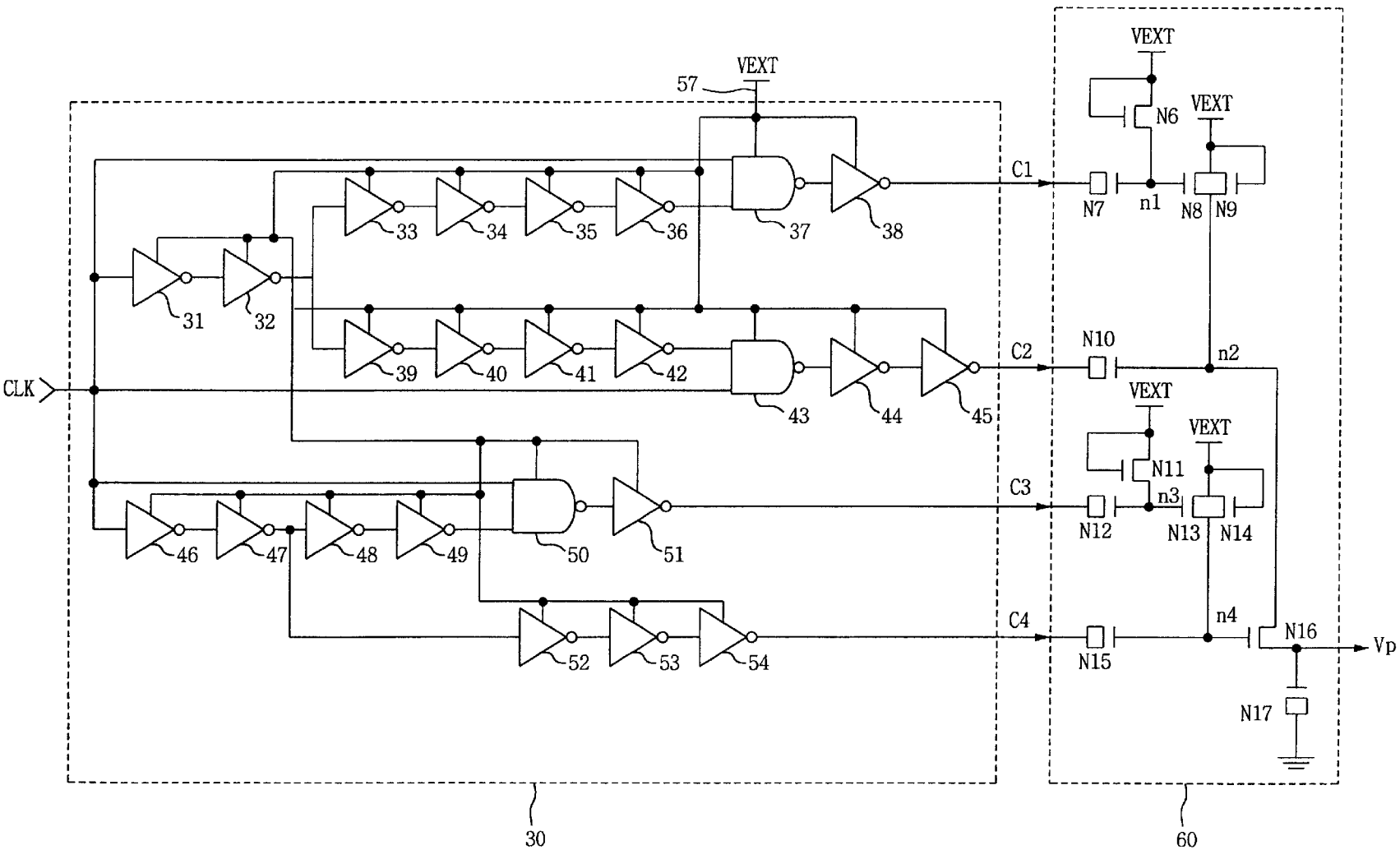
FIG.3(Prior Art)
FIG. 3 is a detailed circuit diagram of timing controller 30 and booster 60 of FIG. 1.

The boosting part 60 in FIG. 3 is designed so that external voltage VEXT can be lowered to a desired level by the NMOS transistors of the diode structure. Then, the transistors no longer get destroyed, because the voltage difference between the gate and the source of the transistors and between the gate and the drain is not very large.

Figure 4:
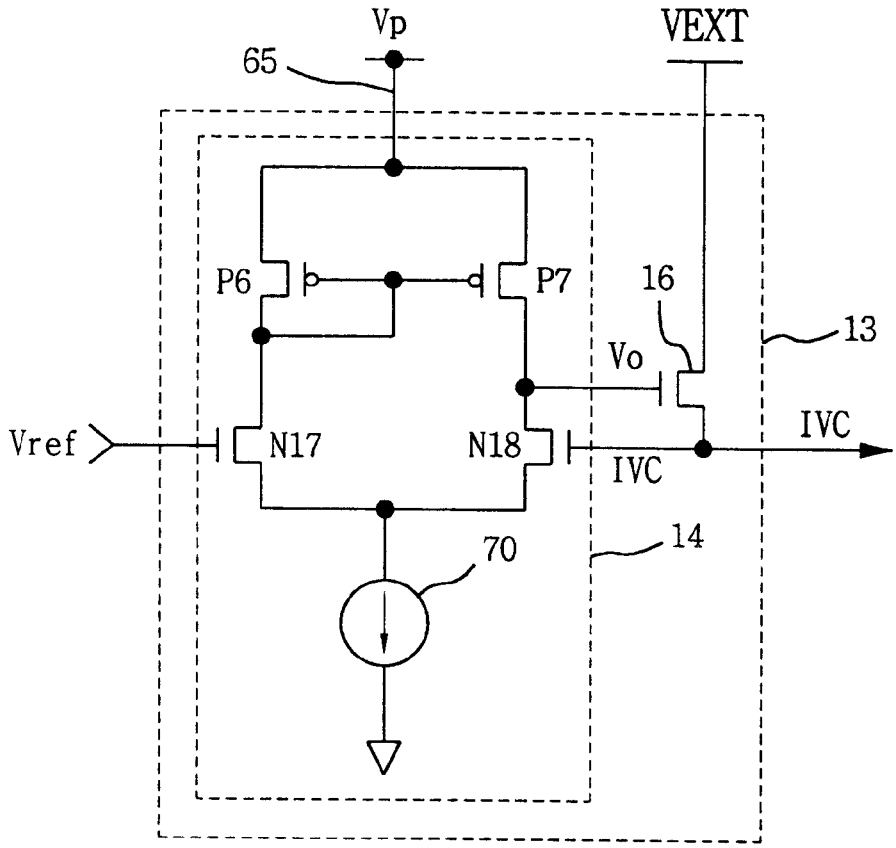
FIG.4(Prior Art)
FIG. 4 is a detailed circuit diagram of a voltage source 13 of FIG. 1.

The voltage source of FIG. 1 is now described in detail referring to FIG. 4. As said above, voltage source 13 comprises a NMOS driver that includes a NMOS transistor 16. Transistor 16 receives the external voltage VEXT and outputs the internal operating voltage IVC. Transistor 16 is controlled by differential comparator 14.

Comparator 14 includes a PMOS transistor P6 with a drain and a gate commonly connected and with a source connected to terminal 65 (where boosted voltage Vp is applied). The comparator also includes a PMOS transistor P7 with a gate connected to the gate of P6 and with a source connected to terminal 65, a NMOS transistor N17 with a gate to which the first reference voltage Vref is applied and with a drain connected to the drain of P6, a NMOS transistor N18 with a source connected to the source of N17, with a gate to which internal operating voltage IVC is applied, and with a drain connected to the drain of P7, and a current source 70 connected between the source of N18 and the ground voltage.

The voltage source works as follows: If the internal operating voltage IVC is lower than the first reference voltage Vref, the current flowing through N17 becomes larger than the current flowing through N18, and an output voltage Vo increases. This will increase IVC until it equals Vref. On the contrary, if the internal operating voltage IVC is higher than the first reference voltage Vref, the current flowing through N17 becomes smaller than the current flowing through N18, and the output voltage Vo decreases. This will decrease IVC until it equals Vref.

As has been mentioned, the invention provides an internal voltage converter. The regulator circuit is now described in more detail with reference to FIG. 5.

Regulator 70 includes a timing pulse generator 17 that is preferably made from a clock signal generator 10 and a timing controller 30. It also includes a booster 60 and a voltage source 13. Source 13 is preferably made from a differential comparator 14 and a NMOS driver that includes an NMOS transistor 16. These components are made similarly to those of FIG. 1.

The regulator further comprises a voltage down converter 18. The down converter receives external voltage VEXT and outputs an intermediate voltage VINT that is lower than VEXT. This intermediate voltage is used to power timing pulse generator 17. VINT is low enough to not destroy the transistors of these circuits.

Voltage down converter 18 can be made as is known in the art. The preferred down converter provides a stable voltage, so that clock signal CLK will not be changing frequency. This is accomplished by having the voltage down converter be a voltage source, as is preferred.

Figure 5:
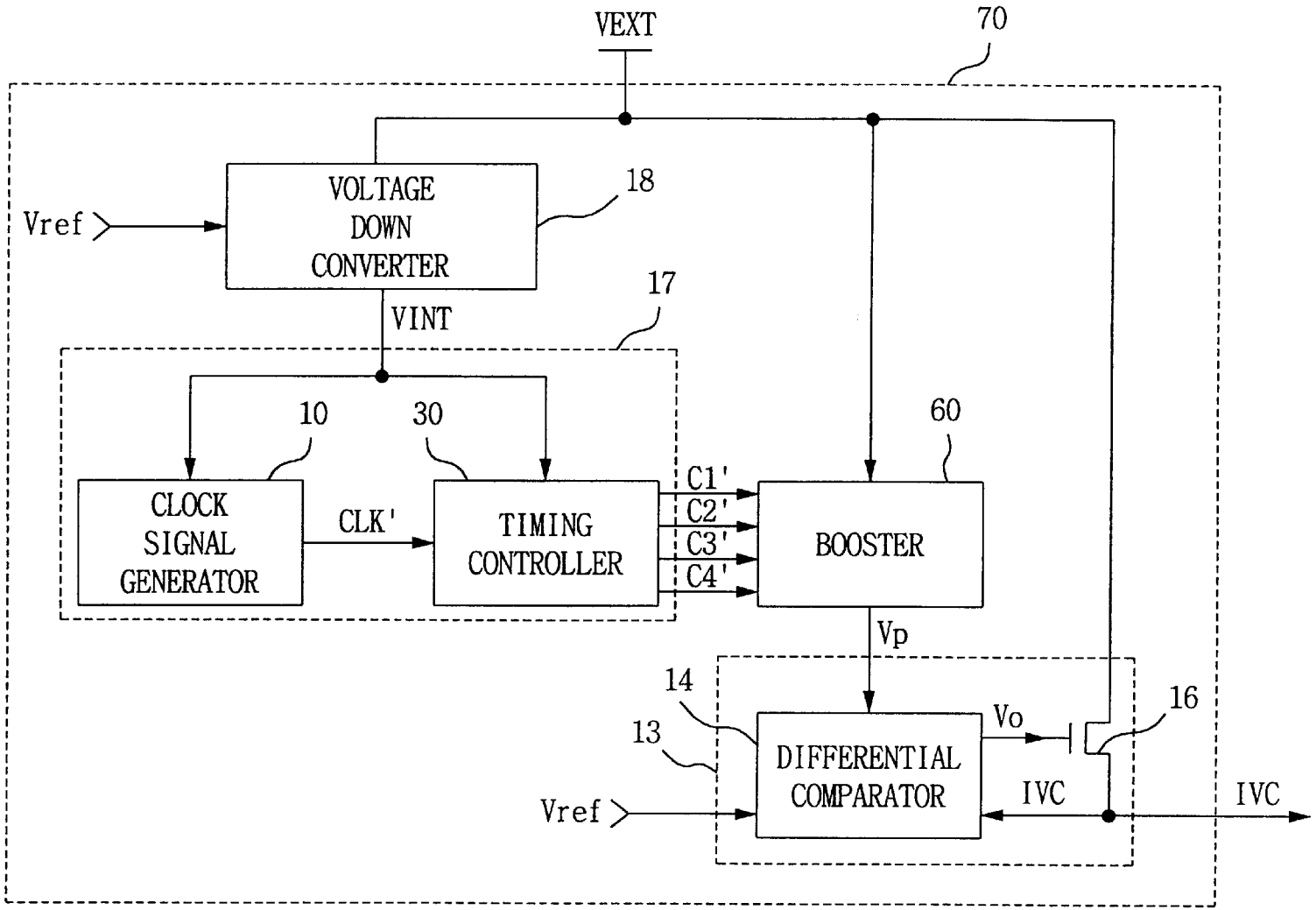
FIG. 5 is block diagram of an internal voltage converter made according to the present invention.

As a result, clock signal generator 10 of FIG. 5 generates a pulse signal CLK' that is of stable frequency and amplitude (ground to VINT). Accordingly timing controller 30 generates timing pulses C1', C2', C3' and C4', that are of stable frequency and amplitude.

Further, booster 60 produces a boosted voltage Vp', which is boosted to a level of VEXT+VINT. This is below the level VEXT+VEXT of Vp of FIG. 1. The reason is that timing pulses C1', C2', C3' and C4' rise to a level of only VINT, not VEXT. Vp' being lower thus protects the transistors of voltage source 13, which works as described above.

Voltage down converter 18 outputs an intermediate voltage VINT. The intermediate voltage can be determined by using a second reference voltage. It is advantageous to use the already present first reference voltage Vref as also the second reference voltage. In that case intermediate voltage VINT will equal the device's internal operating voltage IVC.

Figure 6:
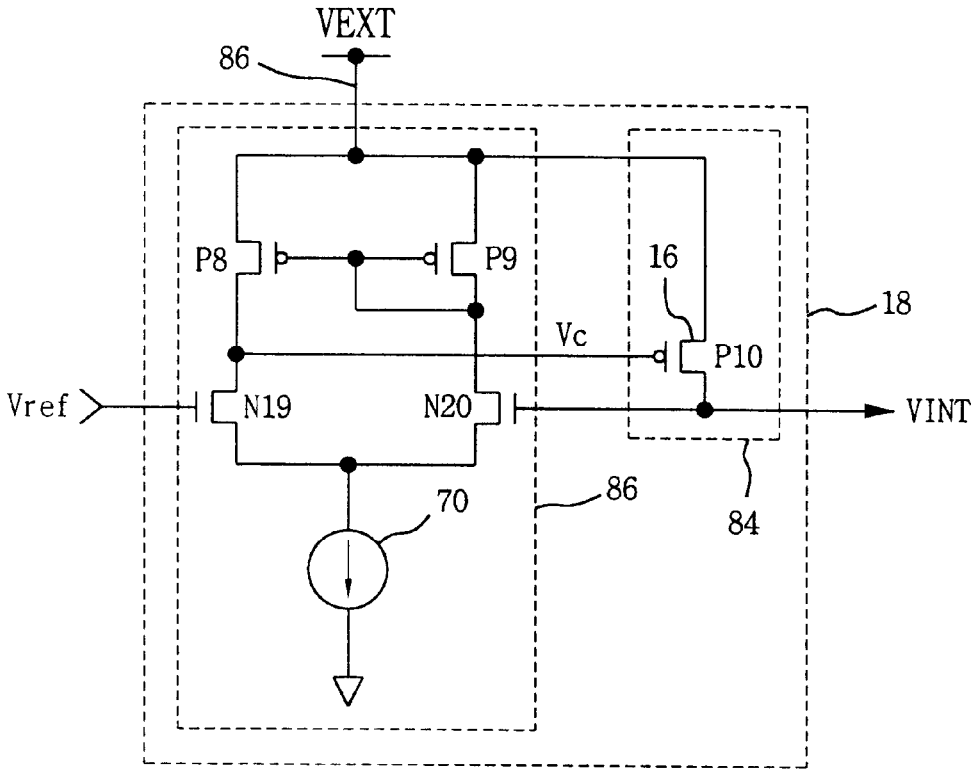
FIG. 6 is a detailed circuit diagram of the preferred embodiment of voltage down converter 18 of FIG. 5.

FIG. 6 shows the preferred embodiment of voltage down converter 18 of FIG. 5. Down converter 18 comprises a second differential comparator 82 and a PMOS driver 84. The PMOS driver includes a PMOS transistor P10 that receives external voltage VEXT at the source, and outputs intermediate voltage VINT from the drain. It is controlled by receiving at the gate a control signal Vc, which is produced by comparator 82.

Differential comparator 82 (also known as second differential comparator) receives external voltage VEXT at a terminal 86. Comparator 82 comprises a PMOS transistor P8 with a source connected to terminal 86 and a drain that produces control voltage Vc, a PMOS transistor P9 with a drain and a gate connected to the gate of P8 and with a source connected to terminal 86, a NMOS transistor N19 with a gate to which reference voltage Vref is applied and with a drain connected to the drain of P8, a NMOS transistor N20 with a source connected to the source of N19, with a gate to which intermediate voltage VINT is applied and with a drain connected to the drain of P9, and a current source 70 connected between the source of N19 and the ground voltage. The current source can be a regular current source.

Voltage down converter 18 operates as follows: If intermediate voltage VINT is higher than reference voltage Vref, the current flowing through N20 becomes larger than the current flowing through N19, and thus the voltage at the drain of N19 increases. That is also Vc, the control voltage applied to the gate of PMOS transistor P10 of driver 84. As Vc increases, intermediate voltage VINT is reduced until it equals reference voltage Vref. Similarly, if intermediate voltage VINT is lower than reference voltage Vref, Vc decreases which causes intermediate voltage VINT to increase until it equals reference voltage Vref.

A person skilled in the art will be able to practice the present invention in view of the present description, where numerous details have been set forth, in order to provide a more thorough understanding of the present invention. It will be obvious, however, to one skilled in the art that the present invention may be practiced without these specific details. In other instances, well known features have not been described in detail in order to not obscure unnecessarily the present invention. Again, one skilled in the art will appreciate that it is possible to make various modifications, additions and substitutions to the present description without departing from the scope and spirit of the invention as claimed in the accompanying claims.

What is claimed is:

1. A voltage regulator circuit for operating a semiconductor memory device comprising:

a voltage down converter for receiving an external voltage and thereby providing an intermediate voltage;

a timing pulse generator for receiving the intermediate voltage and generating a timing signal;

a booster for receiving the timing signal and a predetermined voltage, the booster thereby outputting a boosted voltage; and a voltage source receiving the boosted voltage and the external voltage, and thereby outputting a source voltage for operating the semiconductor memory device, wherein the predetermined voltage is the intermediate voltage.

2. The circuit of claim 1, wherein the voltage down converter receives a second reference voltage and controls the intermediate voltage to equal the second reference voltage.

3. The circuit of claim 2, wherein the voltage down converter comprises:

a PMOS driver for receiving the external voltage and thereby outputting the intermediate voltage; and a second differential comparator for receiving the external voltage, the second reference voltage, and the intermediate voltage, and for controlling the PMOS driver such that the intermediate voltage equals the second reference voltage.

4. The circuit of claim 3, wherein the second differential comparator comprises:

a first PMOS transistor with a source to which the predetermined voltage is applied;

a second PMOS transistor with a source to which the predetermined voltage is applied and with a drain and a gate commonly connected to a gate of the first PMOS transistor;

a first NMOS transistor with a drain connected to the drain of the first PMOS transistor and with a gate to which the second reference voltage is applied;

a second NMOS transistor with a source connected to the source of the first NMOS transistor, with a drain connected to the drain of the second PMOS transistor and with a gate to which the intermediate voltage is applied; and a first current source connected between a ground voltage and the common source of the first and second NMOS transistors, wherein the voltage present at the drain of the first PMOS transistor is applied to the PMOS driver for controlling it.

5. The circuit of claim 1, wherein the intermediate voltage equals the source voltage.

6. The circuit of claim 1, wherein the timing pulse generator comprises a clock signal generator for receiving the intermediate voltage and thereby producing a clock signal, and a timing controller for receiving the clock signal and thereby producing the timing signal.

7. The circuit of claim 6, wherein the clock signal generator comprises a predetermined number of inverters connected consecutively in a ring arrangement, and wherein each inverter receives the intermediate voltage.

8. The circuit of claim 6, wherein the timing signal includes first, second, third and fourth timing pulses.

9. The circuit of claim 1, wherein the booster comprises:

a first NMOS capacitor with a source and a drain to which the first timing pulse is applied;

a first NMOS diode with a source connected to a gate of the first NMOS capacitor and with a gate and a drain to which the intermediate voltage is applied;

a third NMOS transistor with a gate connected to the gate of the first NMOS capacitor and with a drain to which the intermediate voltage is applied;

a second NMOS diode with a source connected to the source of the third NMOS transistor and with a gate and a drain to which the intermediate voltage is applied;

a second NMOS capacitor with a gate connected to the source of the third NMOS transistor and with a source and a drain to which the second timing pulse is applied;

a third NMOS capacitor with a source and a drain to which the third timing pulse is applied;

a third NMOS diode with a source connected to a gate of the third NMOS capacitor and with a gate and a drain to which the intermediate voltage is applied;

a fourth NMOS transistor with a gate connected to the source of the third NMOS diode and with a drain to which the intermediate voltage is applied;

a fourth NMOS diode with a source connected to a source of the fourth NMOS transistor and with a gate and a drain to which the intermediate voltage is applied;

a fourth NMOS capacitor with a gate connected to the source of the fourth NMOS diode and with a drain and a source to which the fourth timing pulse is applied;

a fifth NMOS transistor with a gate connected to the gate of the fourth NMOS capacitor and with a drain connected to the gate of the second NMOS capacitor; and a fifth NMOS capacitor with a drain and a source connected to the ground voltage and with a gate connected to a source of the fifth NMOS transistor, the boosted voltage thereby appearing at the source of the fifth NMOS transistor.

10. The circuit of claim 1, wherein the voltage source further receives a first reference voltage and controls the source voltage to equal the first reference voltage.

11. The circuit of claim 10, wherein the voltage source comprises:

a NMOS driver for receiving the external voltage and thereby outputting the source voltage; and a first differential comparator for receiving the boosted voltage, the first reference voltage and the source voltage and for controlling the NMOS driver such that the source voltage equals the first reference voltage.

12. The circuit of claim 11, wherein the first differential comparator comprises:

a third PMOS transistor with a source to which the boosted voltage is applied;

a fourth PMOS transistor with a source to which the boosted voltage is applied, with a gate connected to a gate and to a drain of the third PMOS transistor;

a sixth NMOS transistor with a drain connected to the drain of the third PMOS transistor and with a gate to which the first reference voltage is applied;

a seventh NMOS transistor with a source connected to the source of the sixth NMOS transistor, with a drain connected to a drain of the fourth PMOS transistor, and with a gate to which the source voltage is applied; and a second current source connected between a ground voltage and the common source of the sixth and seventh transistors, wherein the voltage present at the drain of the fourth PMOS transistor is applied to the NMOS driver for controlling it.

13. The circuit of claim 10, wherein the voltage down converter receives a second reference voltage and controls the intermediate voltage to equal the second reference voltage.

14. The circuit of claim 13, wherein the second reference voltage equals the first reference voltage.

* * * * *